US005448135A

United States Patent [19]

Simpson

[11] Patent Number: 5,448,135

[45] Date of Patent: Sep. 5, 1995

[54] APPARATUS FOR COUPLING ELECTROMAGNETIC RADIATION FROM A WAVEGUIDE TO AN ELECTRODELESS LAMP

[75] Inventor: James E. Simpson, Gaithersburg, Md.

[73] Assignee: Fusion Lighting, Inc., Rockville, Md.

[21] Appl. No.: 141,961

[22] Filed: Oct. 28, 1993

[51] Int. Cl.[6] ..... H01P 5/103; H01J 65/04

[52] U.S. Cl. ..... 315/39; 315/248; 333/26

[58] Field of Search ..... 333/26; 315/39, 248, 315/344

[56] References Cited

U.S. PATENT DOCUMENTS

| | | | |
|---|---|---|---|
| 2,633,493 | 3/1953 | Cohn | 333/248 X |
| 3,478,282 | 11/1969 | Smith | 333/26 X |
| 4,144,506 | 3/1979 | McCannon et al. | 333/26 |
| 4,359,668 | 11/1982 | Ury | 315/39 |
| 4,988,961 | 1/1991 | Schadler | 333/26 |
| 5,039,918 | 8/1991 | Ohtake et al. | 315/39 X |

FOREIGN PATENT DOCUMENTS

| | | | |
|---|---|---|---|
| 55-154055 | 8/1980 | Japan . | |
| 208743 | 9/1986 | Japan | 315/39 |

OTHER PUBLICATIONS

"A 750-TV-Line-Resolution Projector Using 1.5-Megapizel a-Si TFT" by Takeuchi et al, SID 91 Digest.

"Atmospheric Pressure High Power Microwave Plasma Torch: The TIA Design" by Moisan et al, Soumis a Plasma Sources Science and Technology, Jul 29, 1993.

*Primary Examiner*—Benny T. Lee

*Attorney, Agent, or Firm*—Pollock, Vande Sande & Priddy

[57] ABSTRACT

Apparatus for coupling electromagnetic energy to electrodeless lamps. A waveguide having one end connected to a source of electromagnetic radiation was closed at the second opposite end. A coupling device at the second end couples microwave energy from the waveguide to an electrodeless lamp. The coupling device includes a coaxial transmission line having a center conductor extending through one of the walls of the waveguide adjacent the second end. An alcove partition within the waveguide contacts the extending conductor and forms an alcove in the waveguide. The alcove portion provides for an impedance matching structure between the transmission line and waveguide. The electrodeless lamp which is positioned above the free end of the coaxial transmission line is excited with the coupled microwave energy.

12 Claims, 3 Drawing Sheets

APPARATUS FOR COUPLING ELECTROMAGNETIC RADIATION FROM A WAVEGUIDE TO AN ELECTRODELESS LAMP

TECHNICAL FIELD

The present invention relates to microwave-excited electrodeless lamps. Specifically, an apparatus for coupling microwave energy to the electrodeless lamp is described.

BACKGROUND OF THE INVENTION

Electrodeless lamps are used in various applications wherein the longevity of the lamp is a paramount consideration. Such lamps include a sealed translucent envelope containing a gas which can be excited by electromagnetic radiation to generate high intensity white light. The devices receive electromagnetic energy from a microwave signal which is coupled from a standard magnetron microwave source.

A recent application for high-intensity lamps is in the field of projection television systems. These systems require a source of high intensity white light. The white light is separated into the primary red, green and blue colors, each of which is modulated with appropriate red, green and blue (R G B) signals. The modulated red, green and blue images are combined in conventional dichroic mirror structures to produce a composite color image. A projection lens generates an enlarged display image from the magnified composite signal.

Such devices operate for extended periods of time. Conventional projection television systems rely upon either high intensity discharge arc lamps, or CRT devices which are operated at high electron potentials. These devices have a limited operational life, and a consumer may well need to replace these high-intensity light generators several times during the lifetime of the television system.

The electrodeless lamp technology offers the promise of implementing high-intensity light sources with a life expectancy far exceeding the life expectancies of these other prior art light sources. Sufficient light intensity can be generated from a single electrodeless lamp which is used in conjunction with a conventional reflector structure to distribute the light over the aperture of an optical system for producing the red, green and blue images. The optical requirements for projection dictate that the light source must be small, on the order of 5 mm. diameter. A disadvantage of using the electrodeless lamp in this application includes the requirement that they be microwave-excited. The microwave source must generate microwaves having a power level of 100–400 watts, depending on the projector. Sufficient microwave energy must be coupled to the electrodeless lamp where it is converted into radiant white light. The small size of the lamp requires intense electric fields to couple the energy to the lamp. These power levels produce high levels of heat, requiring that the lamp be cooled by a stream of gas, such as compressed air.

The complications associated with exciting an electrodeless lamp with microwave energy include the requirement that a broad-band low reflection coupling be provided between the microwave source and the lamp. Otherwise, the operating frequency tolerances which accompany different microwave sources, such as magnetrons, may produce an unmatched condition which produces microwave reflections which are received in the magnetron. These reflections shift the frequency of the magnetron, producing further losses in efficiency and a corresponding loss of light output.

The present invention is directed to an apparatus which will couple microwave energy from a standard microwave source to an electrodeless lamp with a small reflection coefficient over a bandwidth representing the frequency tolerance of commercial magnetrons.

SUMMARY OF THE INVENTION

It is an object of this invention to ]provide a coupling device for coupling microwave energy to an electrodeless lamp.

It is a further object of this invention to provide for a projection television light source using an electrodeless lamp.

It is yet a more specific object of this invention to provide for a cooled electrodeless lamp structure which is excited from a microwave source.

These and other objects of the invention are provided by a waveguide structure which supports a $TE_{10}$ mode microwave signal, coupled at one end to a source of microwave energy, and closed at a second end. A coupling device is provided at the closed end for coupling microwave energy within the waveguide to an electrodeless lamp.

The coupling device includes an opening in a wall of the waveguide structure adjacent the closed end, which faces an alcove formed by a partition which occludes a major portion of the waveguide cross-sectional area, leaving a minor amount of area which defines the alcove. The alcove extends from underneath the opening in the wall of the waveguide to the closed end of the waveguide.

One end of the center conductor of a coaxial transmission line structure is inserted through the opening into the alcove, and makes electrical contact with the alcove partition. The other end of the center conductor is positioned underneath the electrodeless lamp. A substantially transparent coaxial outer conductor is connected to the exterior of the waveguide wall.

The device provides for a substantially broadband coupling loop between the coaxial transmission line and the rectangular waveguide structure over a 10% bandwidth, impedance matching the coaxial transmission line structure terminated with the electrodeless lamp to the waveguide structure.

DESCRIPTION OF THE PREFERRED EMBODIMENT

Figure 1:
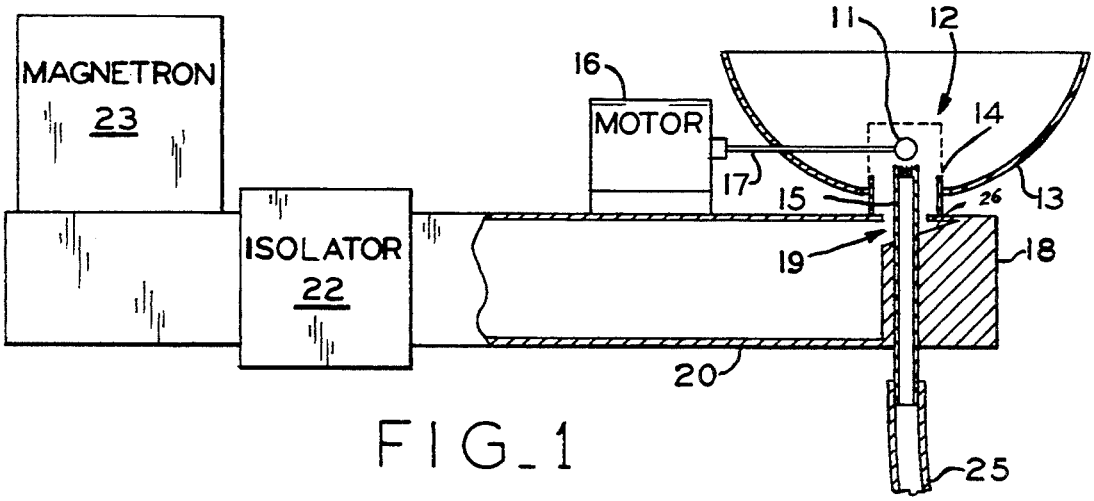
FIG. 1 illustrates a light source for a projection television which uses an electrodeless lamp.
Figure 2:
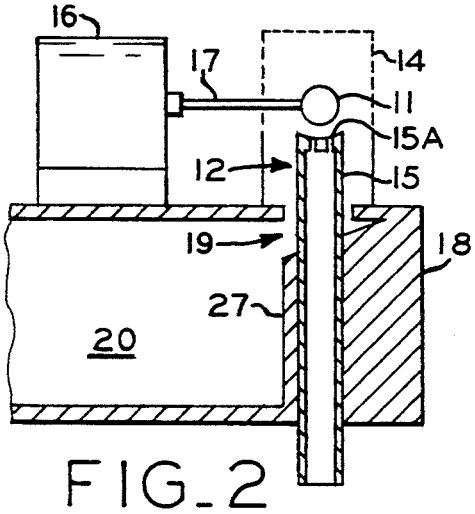
FIG. 2 is a section view of a preferred embodiment of the invention for coupling electromagnetic energy from a waveguide structure to an electrodeless lamp.
Figure 5:
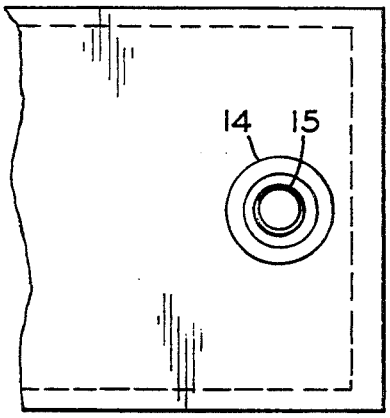
FIG. 5 is a top view of the device of FIG. 4.

Referring now to FIG. 1, there is shown a light source for generating a high intensity white light, especially for use in projection television applications. FIGS. 2 and 5 illustrate the microwave coupling portions of FIG. 1 in greater detail. The device includes an electrodeless lamp 11 as a light-emitting element. The electrodeless lamp 11 is supported on a rotating shaft 17, driven by motor 16. The lamp 11 is rotated at a speed which is greater than 8,000 RPM to facilitate cooling of the lamp structure, as well as to uniformly excite the gas within the electrodeless lamp.

The electrodeless lamp 11 is excited by microwave electromagnetic energy which exits a coaxial transmission line structure 12 having a center conductor 15 and an outer conductor 14. The coaxial transmission line structure is coupled to a waveguide 20. The waveguide 20 is in turn connected through an isolator 22 to a magnetron 23.

Light from the electrodeless lamp 11 passes through the transparent outer conductor structure 14 which may be a cylindrically-formed wire mesh, and is incident to a reflector 13. The reflector 13 has an aperture coextensive with the entrance aperture of the optical system of a projection television.

The magnetron 23 has a frequency in the ISM microwave band which is centered at 2450 MHz. An isolator 22 effectively isolates any energy reflected from the waveguide section 20 which may shift the frequency of operation of magnetron 23 away from a nominal frequency. As the waveguide 20 is matched in a particular frequency range to deliver maximum microwave power to the lamp 11, any frequency tolerance associated with the magnetron 23 could result in a reflection being returned from waveguide 20 pulling the frequency of the magnetron 23 from its nominal frequency further increasing the size of the reflection. Increases in reflected energy consequently reduce the amount of energy delivered to a load.

The coupling of electromagnetic energy from the waveguide 20 to the electrodeless lamp 11 is provided by a transmission line structure comprising a center conductor 15 and outer conductor 14. The center conductor 15 passes through an opening in the waveguide 20 into a coupling chamber 19 defined as an alcove formed at the end of the waveguide 20. The section of center conductor 14 which is exposed in the alcove 19 forms a coupling loop. The alcove 19 is shaped to provide for an impedance match between the coaxial transmission line defined by center conductor 15 and outer conductor 14 to the waveguide 20. The waveguide is terminated at the second end by a short 18.

The center conductor 15 is hollow and exits the waveguide through a clearance hole, spaced from the upper wall of the waveguide 20 to avoid arcing therewith. The other end of the center conductor 15 extends through the partition 26, defining the alcove, and exits through the opposite side of the waveguide 20.

The hollow center conductor 15 is connected to a source of compressed air 25 and supplies cooling air to the surface The microwave circuit, of the electrodeless lamp 11 comprising the waveguide 20, alcove 19 and coaxial transmission line 12 couples the magnetron-produced microwave energy to the electrodeless lamp 11, causing it to emit high-intensity white light. A motor 16 connected to shaft 17 rotates the electrodeless lamp 11 so that: cooling air uniformly cools the surface of the electrodeless lamp 11. The rotation additionally uniformaly illuminates the electrodeless lamp 11 with microwave energy.

The outer conductor 14 of the coaxial transmission line 12 is transparent to light and, in a preferred embodiment, comprises a mesh conductor, terminating on the upper wall of waveguide 20, extending above the electrodeless lamp 11.. The outer conductor 14 mesh extends above the electrodeless lamp 11 to shield significant levels of radio frequency energy from being radiated by the transmission line.

Figure 3:
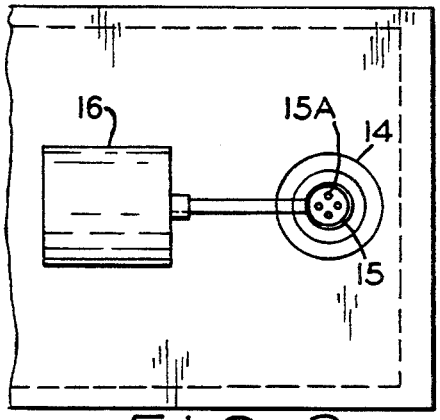
FIG. 3 is a top view of the coupling device of FIG. 2.
Figure 6A:
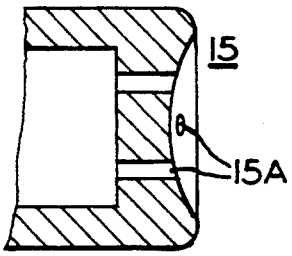
FIG. 6A is a section view of the center conductor of the coaxial transmission line of the embodiment of FIG. 1.
Figure 6B:
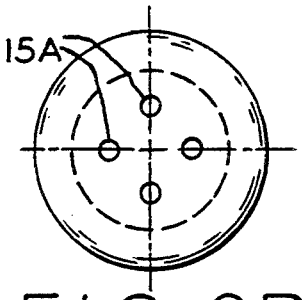
FIG. 6B is a top view of the center conductor of the coaxial transmission line of FIG. 1.

FIG. 2 illustrates in greater detail the structure of the coupling device of FIG. 1 connecting microwave waveguide 20 and transmission line 12. FIG. 3 is a top view of the coupling device shown in FIG. 2. The alcove 19 is formed by an alcove partition 27 which occludes a major portion of the area of the waveguide 20. The alcove 19, in the preferred embodiment, is shown as a wedge-shaped alcove having an entrance aperture, and which decreases in area in the direction of the short circuited waveguide end 18. An apertured surface 15a, as shown in FIGS. 6A, 6B, is provided on the end of center conductor 15 (see FIG. 6A), creating a stream of air for cooling the electrodeless lamp 11. The apertured surface 15a is curved and has a center of curvature common to the electrodeless lamp 11 center of curvature. This provides a constant distance between the end of the enter conductor and the surface of electrodeless lamp 11.

Since there is little RF electric field in the alcove 19, the RF magnetic field filling the space is constant, and equal to the value of the field tangent to the end of the waveguide 20. The coupling loop, excited by this field, is bounded by the middle of the center conductor 15, the upper waveguide wall and the alcove partition 27, and has a typical area of 50 square millimeters. Such a small loop couples effectively only to low impedances. The coupling from the waveguide to the coaxial transmission line would provide a voltage reflection coefficient in the waveguide greater than 0.8 if the coaxial transmission line was terminated in its own characteristic impedance, instead of the electrodeless lamp. A conventional coupling loop for joining the waveguide to the characteristic impedance of a coaxial line, typically 50 Ohms., would have about 10 times more area. FIGS. 4, 5, 7A, 7B and 8 show other embodiments of the invention. The same reference numerals have been used to identify the same elements in each of these embodiments.

Figure 4:
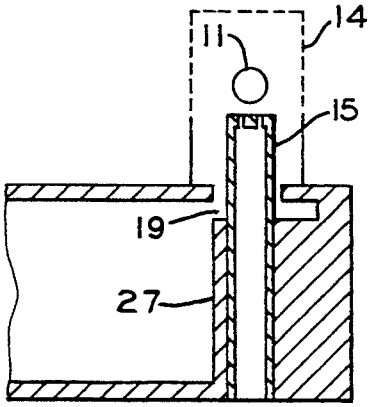
FIG. 4 is a section view of yet another embodiment of a coupling device in accordance with the invention.

FIGS. 4 and 5 illustrate yet another embodiment of the coupling device in accordance with the present invention which constitutes only slight changes to the embodiment shown in FIGS. 1–3. This embodiment differs only in that the alcove 19 has a different shape.

FIG. 5 is a top view of FIG. 4, and illustrates that the alcove 19 can be of rectangular shape, and defined by a partition 27. In all cases, sufficient clearance must be left between the top sidewall and the center conductor 15 to avoid arcing. FIGS. 6A and 6B illustrate the tip of the center conductor 15 (see FIG. 6A) having the plurality of holes 15*a* which may be implemented in the embodiments of FIGS. 1–5. As can be seen, there is a radius of curvature on the top surface to maintain a constant distance between the center conductor and the surface of the electrodeless lamp.

Figure 7A:
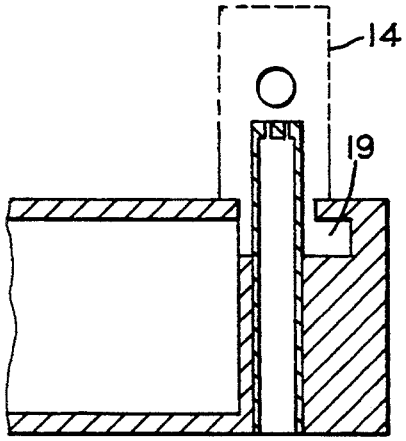
FIG. 7A is a section view of yet another embodiment of the device in accordance with the invention.
Figure 7B:
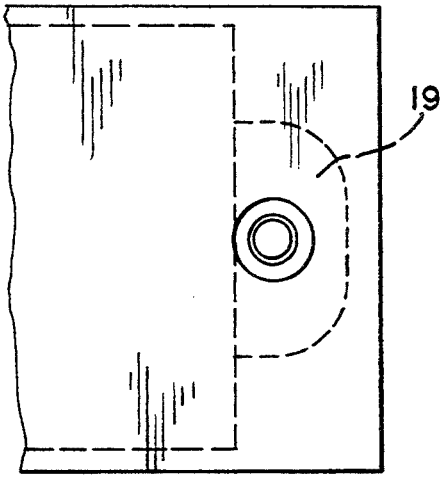
FIG. 7B is a top view of the additional embodiment of FIG. 7A.
Figure 8:
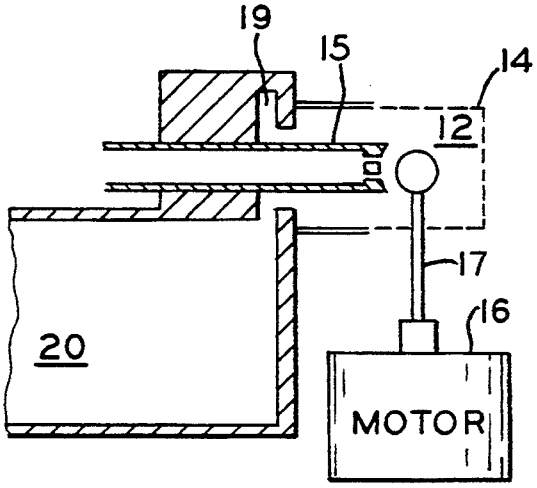
FIG. 8 is a section view of another embodiment of the invention.

FIGS. 7A, 7B and 8 illustrate other embodiments of the invention, all of which use a rectangular alcove structure 19 for providing a transition between transmission line 12 and the microwave waveguide 20 as seen in FIG. 8. The alcove structure 19 of FIGS. 7A and 7B has a reduced width, as opposed to the full width of the rectangular waveguide. FIG. 8 shows an alcove structure 19 which extends perpendicular to the main axis of the waveguide 20.

Figure 9:
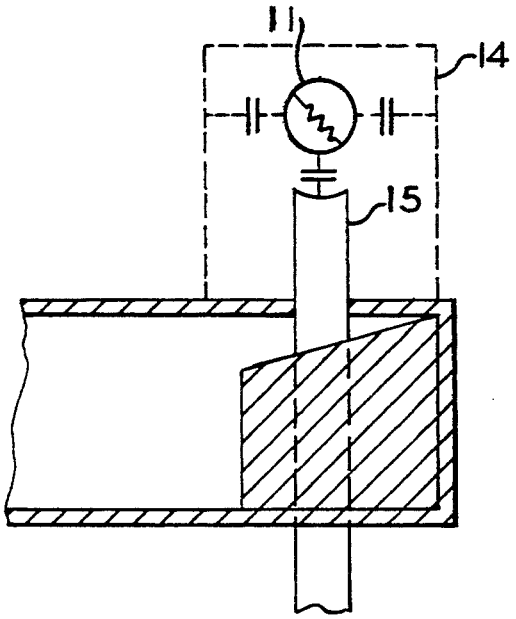
FIG. 9 illustrates the electrical coupling between the free end of the center conductor of the coaxial transmission line and the electrodeless bulb.

The operation of the coupling mechanism can be explained with reference to the equivalent circuit of FIGS. 9, 10 and 11. FIG. 9 illustrates an equivalent discrete circuit showing how the electrodeless lamp 11, which is essentially a resistive load, is capacitively coupled to the transmission line 12. The resulting termination complex impedance is approximately 20—j300.

Figure 10:
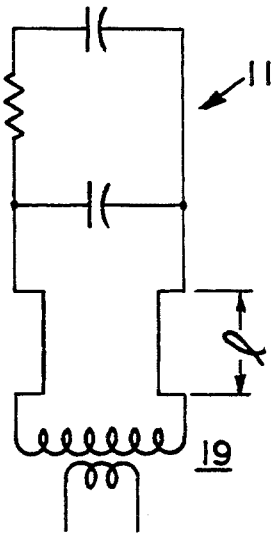
FIG. 10 is a schematic drawing illustrating the electrical coupling between the coaxial transmission line and the waveguide.

FIG. 10 illustrates that by adjusting the length L of the transmission line 12, connecting the electrodeless lamp 11 (represented in an equivalent circuit) the effective impedance presented to the transformer representing the coupling presented by alcove 19 is changed.

Figure 11:
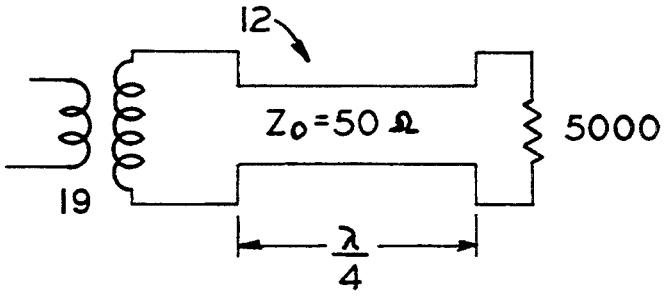
FIG. 11 is a schematic drawing of the transmission line including an electrodeless lamp which produces a reflection coefficient which is to be matched by the waveguide coupling device.

FIG. 11 illustrates how, by adjusting the length of the coaxial line 12, connected to alcove 19 (represented in an equivalent circuit as an inductive coupling element) the load can be made purely resistive. Using conventional Smith chart representations, the length is increased until the load seen at the opposite end of the transmission line is purely resistive. Using the electrodeless lamps of the current assignee of the present application, the resistive component of the impedance is determined using this method as approximately 5,000 Ohms. This represents a mismatch to the coaxial line (having a nominal Zo equal to 50 Ohms), producing a voltage reflection coefficient of 98%. This impedance reflected back to the waveguide is equivalent to a pure 5,000 Ohm resistance at a distance of $\frac{1}{4}$ wave from the waveguide, and is seen at the waveguide as approximately one-half an Ohm.

To match the coaxial line input impedance to the waveguide, the coupling is adjusted with the alcove structure to match the output impedance of the waveguide to the $\frac{1}{2}$ Ohm coaxial line input impedance. Low coupling produces a lower output impedance, which approaches the low input impedance of the lamp terminated coaxial lines. The reflection coefficients of the two structures are complimentary and an impedance match is obtained over a limited bandwidth.

In the preferred embodiment of the invention, the alcove partition occludes approximately 80% of the waveguide 20, and the width of the alcove is the same as the interior width of the waveguide 20. This can be narrowed in accordance with the embodiment represented in FIG. 7B when other alcove shapes are employed.

Thus, there is described a technique for coupling microwave energy to an electrodeless lamp 11 with a minimum coefficient reflection and therefore a maximum power transfer. Those skilled in the art will recognize yet other embodiments defined by the claims which follow.

What is claimed is:

1. An apparatus for coupling electromagnetic radiation to an electrodeless lamp comprising:
   - a waveguide having one end connected to a source of electromagnetic radiation, and a closed second end;
   - a coupling device adjacent said second end for coupling electromagnetic radiation from said waveguide including:
     - an alcove partition adjacent said closed end which occludes a major portion of said waveguide's cross-sectional area defining an alcove within said waveguide; and,
     - a coaxial transmission line having a center conductor extending through one wall of said waveguide, said center conductor contacting a surface of said alcove partition, and having an outer conductor substantially transparent to light connected at one end thereof to said waveguide and extending above one end of said center conductor, thereby enclosing the electrodeless lamp, said coaxial transmission line coupling electromagnetic radiation from said waveguide to electrodeless lamp.

2. The apparatus for coupling electromagnetic energy of claim 1, wherein said coaxial transmission line center conductor extends through said alcove partition and exits a second wall of said waveguide opposite said first wall.

3. The apparatus of claim 2, wherein said coaxial transmission line center conductor is hollow and is connected to a source of gas for cooling the lamp which is positioned opposite said one end of said center conductor.

4. The apparatus of claim 3, wherein said center conductor one end adjacent opposite said lamp has an apertured surface which provides said gas to said lamp.

5. The apparatus of claim 4, wherein said apertured surface is curved along a radius which extends through said lamp.

6. The apparatus of claim 1 wherein said alcove partition is a surface opposite said one wall extending to said closed end defining a rectangular alcove.

7. The apparatus of claim 1 wherein said alcove partition includes an inclined surface opposite said one wall which defines said alcove in the form of a wedge.

8. An apparatus for coupling electromagnetic energy to an electrodeless lamp comprising:
   - a rectangular waveguide having one end connected to a source of electromagnetic energy; and,
   - a coupling member disposed in an opposite second end of said waveguide defining an alcove having an interior cross-sectional area which decreases in the direction away from said waveguide one end, said coupling member further including:
   - a coaxial transmission line, having a coaxial center conductor contacting a wall of said alcove and extending through an opening in a wall of said waveguide to an end position adjacent said electrodeless lamp, said coaxial transmission line further having a coaxial outer conductor substantially transparent to light enclosing said center conductor and connected to said wall through which said center conductor extends, and which encloses said electrodeless lamp.

9. The apparatus for coupling electromagnetic energy of claim 8, wherein said coupling member provides coupling between said waveguide and said coaxial transmission line, which produces a voltage reflection coefficient in said waveguide greater than 0.8 when said coaxial transmission line is terminated in its own characteristic impedance.

10. The apparatus of claim 8, wherein said center conductor passes through said alcove and is connected to a source of cooling gas.

11. The apparatus of claim 10, wherein said center conductor one end includes an apertured surface which directs said cooling gas to a surface of said electrodeless lamp.

12. The apparatus of claim 11, wherein said apertured surface is curved along a radius which extends through said electrodeless lamp.

* * * * *